US009239567B2

(12) United States Patent
Sato

(10) Patent No.: US 9,239,567 B2
(45) Date of Patent: Jan. 19, 2016

(54) DATA PROCESSING APPARATUS, CONDENSATION REMOVAL METHOD AND PROGRAM THEREOF

(71) Applicant: CANON KABUSHIKI KAISHA, Tokyo (JP)

(72) Inventor: Hirochika Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/329,691

(22) Filed: Jul. 11, 2014

(65) Prior Publication Data

US 2014/0321879 A1 Oct. 30, 2014

Related U.S. Application Data

(63) Continuation of application No. 13/240,790, filed on Sep. 22, 2011, now Pat. No. 8,811,852.

(30) Foreign Application Priority Data

Sep. 27, 2010 (JP) ..... 2010-215665

(51) Int. Cl.

| | |
|---|---|
| ***G03G 15/00*** | (2006.01) |
| ***G03G 21/00*** | (2006.01) |
| ***G03G 21/20*** | (2006.01) |

(52) U.S. Cl.

CPC ..... *G03G 21/203* (2013.01); *G03G 15/502* (2013.01); *G03G 15/5079* (2013.01); *G03G 15/5087* (2013.01); *G03G 2215/00109* (2013.01)

(58) Field of Classification Search

CPC . G03G 15/00; G03G 15/502; G03G 15/5079; G03G 15/5087; G03G 21/00; G03G 21/203; G03G 2215/00109; B41J 2/01

USPC ..... 399/34

See application file for complete search history.

(56) References Cited

U.S. PATENT DOCUMENTS

| | | | | |
|---|---|---|---|---|
| 4,982,231 A * | 1/1991 | Matsuuchi | ..... | 399/35 |
| 5,530,523 A | 6/1996 | Kawabata | | |
| 7,177,561 B2 * | 2/2007 | Serita | ..... | G03G 21/203 399/44 |
| 2009/0035032 A1 | 2/2009 | Etoh | | |

FOREIGN PATENT DOCUMENTS

| | | | | |
|---|---|---|---|---|
| JP | 57-8552 A | | 1/1982 | |
| JP | 58-147770 A | | 9/1983 | |
| JP | 61080185 A | * | 4/1986 | ..... G03G 21/00 |
| JP | 61080186 A | * | 4/1986 | ..... G03G 21/00 |
| JP | 62043684 A | * | 2/1987 | ..... G03G 21/00 |
| JP | 62288877 A | * | 12/1987 | ..... G03G 15/00 |
| JP | 63-129357 A | | 6/1988 | |
| JP | 64-49061 A | | 2/1989 | |
| JP | 01049061 A | | 2/1989 | |
| JP | 2-163768 A | | 6/1990 | |
| JP | 08-234649 A | | 9/1996 | |

(Continued)

*Primary Examiner* — Nguyen Ha

(74) *Attorney, Agent, or Firm* — Canon USA Inc. IP Division

(57) ABSTRACT

An image forming apparatus includes a condensation removal unit configured to perform condensation removal absorbing condensation with toner in the image forming apparatus, and a setting unit configured to set an amount of toner to be used for the condensation removal, wherein the condensation removal unit performs the condensation removal by using the mount of toner set by the setting unit.

8 Claims, 5 Drawing Sheets

(56) References Cited

FOREIGN PATENT DOCUMENTS

| | | | | | |
|---|---|---|---|---|---|
| JP | 8-234649 | A | | 9/1996 | |
| JP | 2000-181321 | A | | 6/2000 | |
| JP | 2002-14589 | A | | 1/2002 | |
| JP | 2002-116666 | A | | 4/2002 | |
| JP | 2004-144995 | A | | 5/2004 | |
| JP | 2005-3769 | A | | 1/2005 | |
| JP | 2005003769 | A | * | 1/2005 | ..... G03G 21/00 |
| JP | 2005-300738 | A | | 10/2005 | |
| JP | 2006-206236 | A | | 8/2006 | |
| JP | 2006208996 | A | * | 8/2006 | ..... G03G 21/00 |
| JP | 2008-122814 | A | | 5/2008 | |
| JP | 2008111923 | A | * | 5/2008 | ..... G03G 21/00 |
| JP | 2008170894 | A | * | 7/2008 | ..... G03G 15/00 |
| JP | 2009-69764 | A | | 4/2009 | |
| JP | 2010-60758 | A | | 3/2010 | |

* cited by examiner

DATA PROCESSING APPARATUS, CONDENSATION REMOVAL METHOD AND PROGRAM THEREOF

CROSS REFERENCE TO RELATED APPLICATIONS

The present application is a Continuation of U.S. patent application Ser. No. 13/240,790 filed Sep. 22, 2011, which claims priority from Japanese Patent Application No. 2010-215665 filed Sep. 27, 2010, each of which is hereby incorporated by reference herein in its entirety.

BACKGROUND OF THE INVENTION

1. Field of the Invention

The present invention relates to a data processing apparatus that can perform condensation removal.

2. Description of the Related Art

A data processing apparatus that performs condensation removal is provided.

Japanese Patent Application Laid-Open No. 2008-122814 discusses a technology in which an image forming apparatus determines whether condensation is generated therein, and in a case it makes a determination that the condensation is generated, it performs the condensation removal. The image forming apparatus detects temperature and humidity therein and makes determination based on the detection result.

Further, Japanese Patent Application Laid-Open No. 2004-144995 discusses a technology in which a user choose whether to move to a condensation resolving mode. In a case the user chooses to move to the condensation resolving mode, the image forming apparatus performs the condensation removal.

Only by determining whether the condensation is generated according to rule, the condensation removal is not always performed with a correct timing. Therefore, it is useful that a user can instruct to execute the condensation removal.

However, if the condensation removal is performed only according to the instruction by the user, the condensation removal may be performed with a timing that is not desirable for performing the condensation removal. In this case, the condensation may not be appropriately removed or a job being performed by the data processing apparatus may be disturbed.

Furthermore, if, during the performance of the condensation removal, another job is started to perform, the condensation removal may be disturbed not to be normally completed.

SUMMARY OF THE INVENTION

The present invention is directed to condensation removal to be performed with a more appropriate timing.

According to an aspect of the present invention, an image forming apparatus includes: a condensation removal unit configured to perform condensation removal absorbing condensation with toner in the image forming apparatus; and a setting unit configured to set an amount of toner to be used for the condensation removal, wherein the condensation removal unit performs the condensation removal by using the mount of toner set by the setting unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
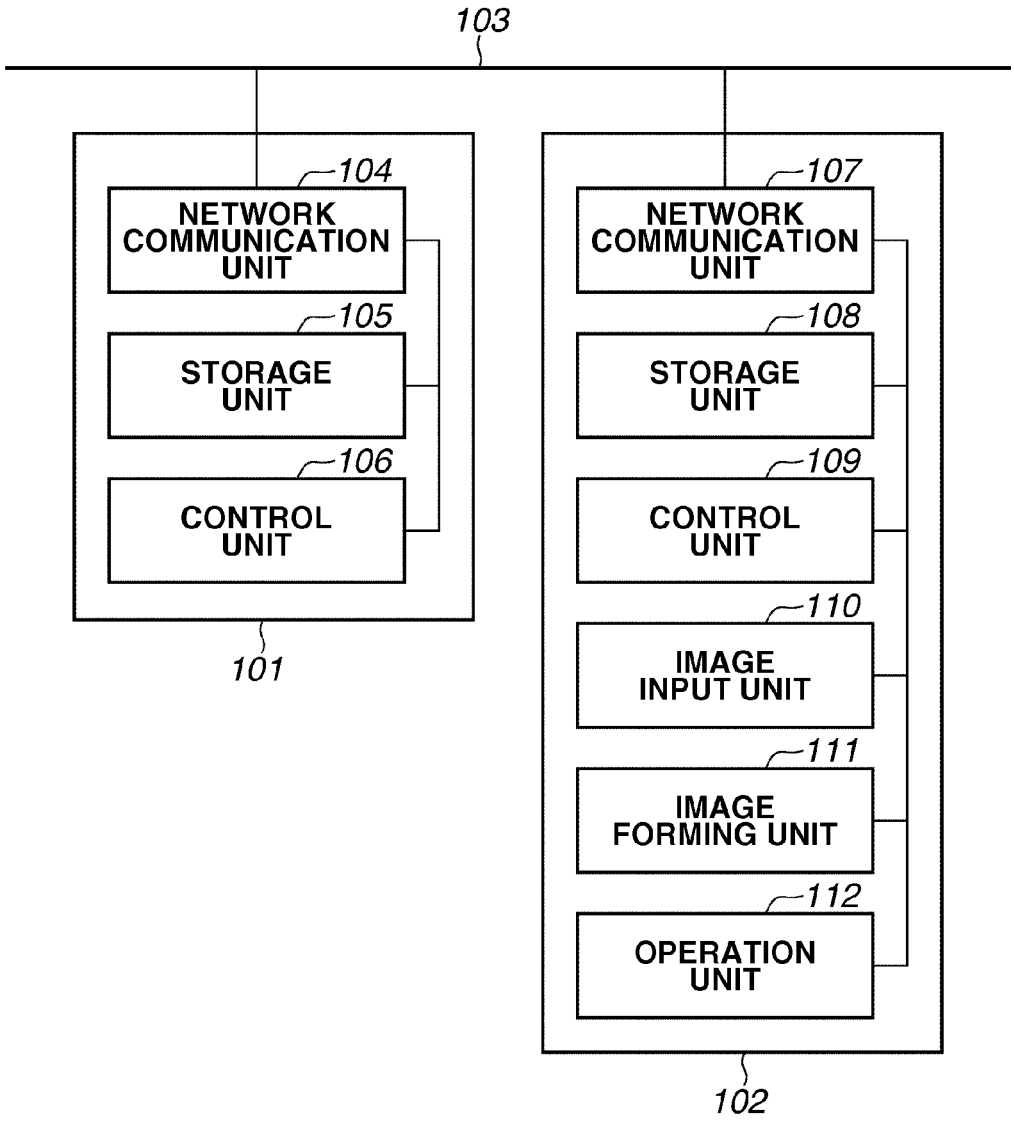
FIG. 1 is a block diagram illustrating a print system according to the present invention.

FIG. 1 is a block diagram illustrating a print system according to the present invention. As an example of a data processing apparatus according to the present invention, an image forming apparatus will be described below.

In this print system, an information processing apparatus 101 and an image forming apparatus 102 are connected to each other via a network 103. The information processing apparatus 101 includes a desk top personal computer (PC) and a laptop PC. The network 103 includes a wired local area network (LAN), the Internet, and a universal serial bus (USB). The network 103 may be a wireless LAN.

The information processing apparatus 101 includes a network communication unit 104, a storage unit 105, and a control unit 106. In addition, the information processing apparatus 101 includes a keyboard, a mouse, and a display, which are not illustrated in FIG. 1.

The network communication unit 104 transmits print data to the image forming apparatus 102 and receives apparatus information and print results from the image forming apparatus 102. The storage unit 105 includes a read only memory (ROM), a random access memory (RAM), and a hard disk drive (HDD). The storage unit 105 stores print data and information (e.g., print setting value) about setting of a print job.

A control unit 106 includes a central processing unit (CPU). The CPU executes a control program stored in the storage unit 105 such as a document generating application and a printer driver, to perform various kinds of information processing. The control unit 106 controls the network communication unit 104 to read the print data and the print setting value from the storage unit 105 and transmit them to the image forming apparatus 102. The image forming apparatus 102 includes a network communication unit 107, a storage unit 108, a control unit 109, an image input unit 110, an image forming unit 111, and an operation unit 112.

The network communication unit 107 receives the print data and the print setting value from the information processing apparatus 101, and transmits the apparatus information about the image forming apparatus 102 and the print results to the information processing apparatus 101. The storage unit 108 includes a ROM, a RAM, and a HDD. The storage unit 108 stores the print data and the print setting value that are received from the information processing apparatus 101, the image data read by the image input unit 110, various kinds of programs, and screen information displayed on the operation unit 112.

The control unit 109 includes the CPU. The CPU executes a control program stored in the storage unit 108 to control the image forming apparatus 102. The control unit 109 generates the print job (e.g., copy job) according to a print start instruction input via the operation unit 112, and the storage unit 108 stores image data (hereinafter, referred to as "print data" including this image data) read by the image input unit 110.

Further, the control unit 109 generates the print job (e.g., page description language (PDL) print job) according to the print data received from the information processing apparatus 101, and the storage unit 108 stores the print data. A control unit 109 adds an identifier (job identification ID) for specifying the generated print job to a job list stored in the storage unit 108.

The control unit 109 controls the image forming unit 111 to read the print data stored in the storage unit 108 according to an order of the job list and form an image based on the print data on recording paper. In a case the image formation based on the print job is completed, the control unit 109 deletes the identifier corresponding to the print job from the job list.

Furthermore, the control unit 109 executes a condensation removal processing program, transmits a condensation removal request to the image forming unit 111 according to the condensation removal instruction input via the operation unit 112, and gives the image forming unit 111 an instruction to perform the condensation removal.

The image input unit 110 is, for example, a scanner, which reads the image to generate the print data. The image forming unit 111 is, for example, a printer engine, which prints the image based on the print data on the recording paper. The operation unit 112 is, for example, a touch panel, which functions as a reception unit that receives the instruction from the user and as a display unit that displays various kinds of information.

Figure 2:
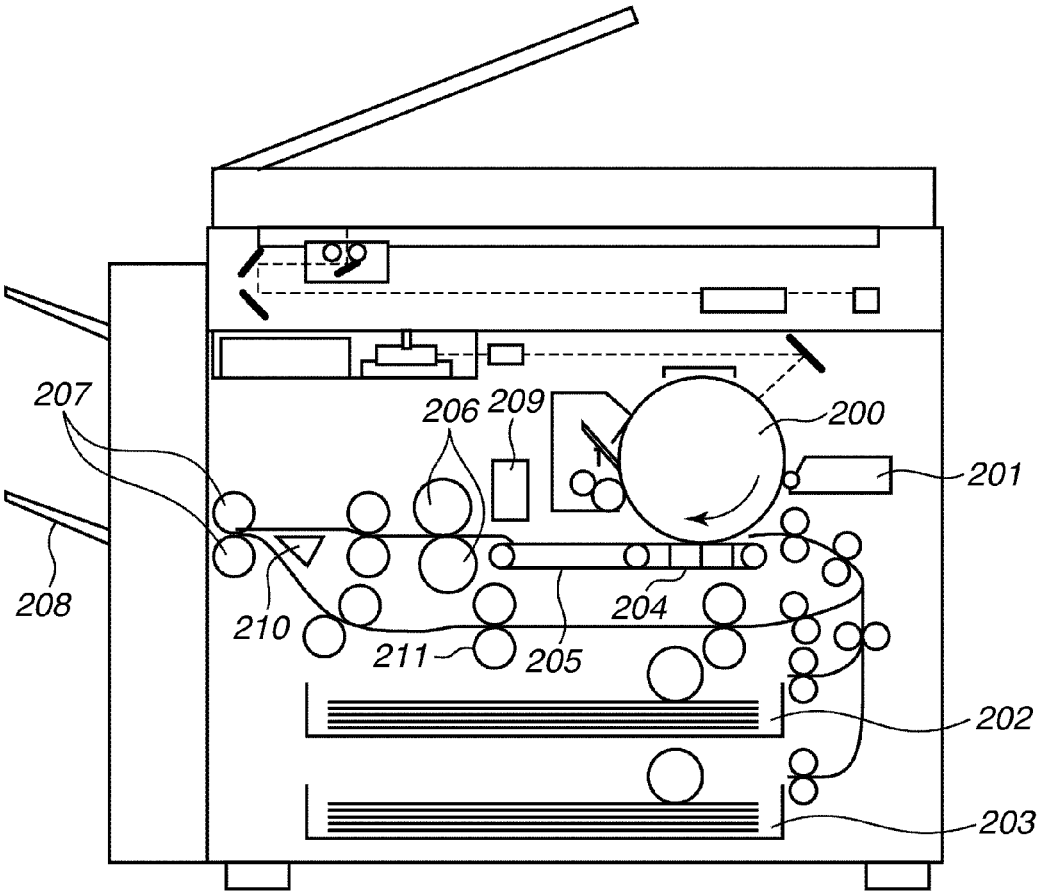
FIG. 2 illustrates an internal configuration of an image forming unit 111.

FIG. 2 illustrates an internal configuration of the image forming unit 111.

The control unit 109 executes an image forming control program to control the image forming unit 111 to form the image based on the print data on the recording paper. In this case, the control unit 109 transmits/receives to/from the image forming unit 111 the print data, a control command, and status information about the image forming unit 111. The control command is an instruction such as a paper feeding request and a condensation removal request.

In a case the image forming unit 111 receives the paper feeding request from the control unit 109, the image forming unit 111 determines whether paper feeding is possible. In a case the paper feeding is possible, the image forming unit 111 transmits to the control unit 109 the status information indicating that the paper feeding is possible.

Furthermore, the image forming unit 111 emits laser beam onto a photosensitive drum 200 according to the print data to form a latent image thereon according to the print data. A development unit 201 makes toner therein adheres to the latent image portion of the photosensitive drum 200. With a synchronized timing with a start of emitting the laser beam, the image forming unit 111 causes a paper feeding cassette 202 or 203 to feed the recording paper and conveys the recording paper to an intermediate transfer belt 205. A transfer unit 204 transfers the toner adhering to the photosensitive drum 200 onto the intermediate transfer belt 205.

The intermediate transfer belt 205 transfers the toner onto the recording paper and conveys to a fixing unit 206 the recording paper onto which the toner adheres. The fixing unit 206 fixes the toner onto the recording paper with heat and pressure. The image forming unit 111 performs pre-processing such as increasing a temperature of the fixing unit 206 before starting printing, and then transmits to the control unit 109 the status information indicating the status during the pre-processing. Further, the image forming unit 111 performs post-processing such as decreasing the temperature of the fixing unit 206 after completing printing, and then transmits the status information indicating the status of the post-processing to the control unit 109. The recording paper passing through the fixing unit 206 is discharged by a paper discharge roller 207 to a paper discharge tray 208.

The image forming unit 111 discharges to a waste toner box 209 remaining toner (waste toner) after the toner is transferred onto the recording paper.

In a case the print job performs two-sided printing, after the recording paper which printing has been performed on a first face thereof has been conveyed to the paper discharge roller 207, the image forming unit 111 reversely rotates the paper discharge roller 207. Subsequently, the recording paper is led to the paper re-feed conveyance path 211 by a flapper 210 and further conveyed to the transfer unit 204 from a paper re-feed conveyance path 211. After printing is performed on a second face of the recording paper, the image forming unit 111 conveys to the paper discharge roller 207 the recording paper which printing is performed on the second face thereof. The paper discharge roller 207 discharges to the paper discharge tray 208 the recording paper on which the two-sided printing has been performed.

In a case the paper feeding is not possible, the image forming unit 111 transmits to the control unit 109 the status information indicating that the paper feeding is not possible, and thus operations regarding the latent image, paper feeding, conveying, transferring, and fixing are not performed.

The image forming unit 111 performs the condensation removal by applying the image forming processing described above. The control unit 109 transmits the condensation removal request to the image forming unit 111. In a case receiving the condensation removal request, the image forming unit 111 transmits to the control unit 109 the status information indicating that the condensation removal is being performed and also performs the condensation removal processing as described below.

In the condensation removal processing, the image forming unit 111 forms the latent image corresponding to the image data for the condensation removal on the photosensitive drum 200, and the development unit 201 makes the toner adhere to the latent image portion of the photosensitive drum 200. In this case, the toner absorbs the condensation generated on the photosensitive drum 200 to remove it.

Subsequently, the image forming unit 111 does not cause the paper feeding cassette 202 or 203 to feed the recording paper but drives the intermediate transfer belt 205. The toner is transferred onto the intermediate transfer belt 205. The image forming unit 111 discharges to a waste toner box 209 the toner transferred onto the intermediate transfer belt 205 as the waste toner. Further, after discharging the waste toner into the waste toner box 209, the image forming unit 111 rotates the intermediate transfer belt 205 in idle state to increase the temperature in the image forming apparatus 102. With this arrangement, the condensation is further removed.

After completing the condensation removal processing, the image forming unit 111 transmits to the control unit 109 the status information indicating that the condensation removal is completed.

In the condensation removal using the toner, the larger a consumption amount of the toner and a time of idle rotation are, the higher the effect of the condensation removal can be obtained. On the other hand, the decrease of the toner becomes faster and the time necessary for the condensation removal becomes longer. Thus, the user may set a level of the condensation removal via a setting screen displayed on the operation unit 112.

The control unit 109 causes the storage unit 108 to store a level value input via the operation unit 112, and then the control unit 109 transmits the level value to the image forming unit 111 together with the condensation removal request. The image forming unit 111 determines the toner usage amount and the idle rotation time according to the level value received from the control unit 109, and then performs the condensation removal based on the determined toner usage amount and the idle rotation time.

More specifically, the image forming unit 111 makes the toner corresponding to the determined toner usage amount adheres to the photosensitive drum 200. Further, the image forming unit 111 rotates in idle state the intermediate transfer belt 205 during the determined idle rotation time. With this arrangement, the user can select a balance between the toner usage amount and the time necessary for the condensation removal and an effect of the condensation removal.

Figure 3:
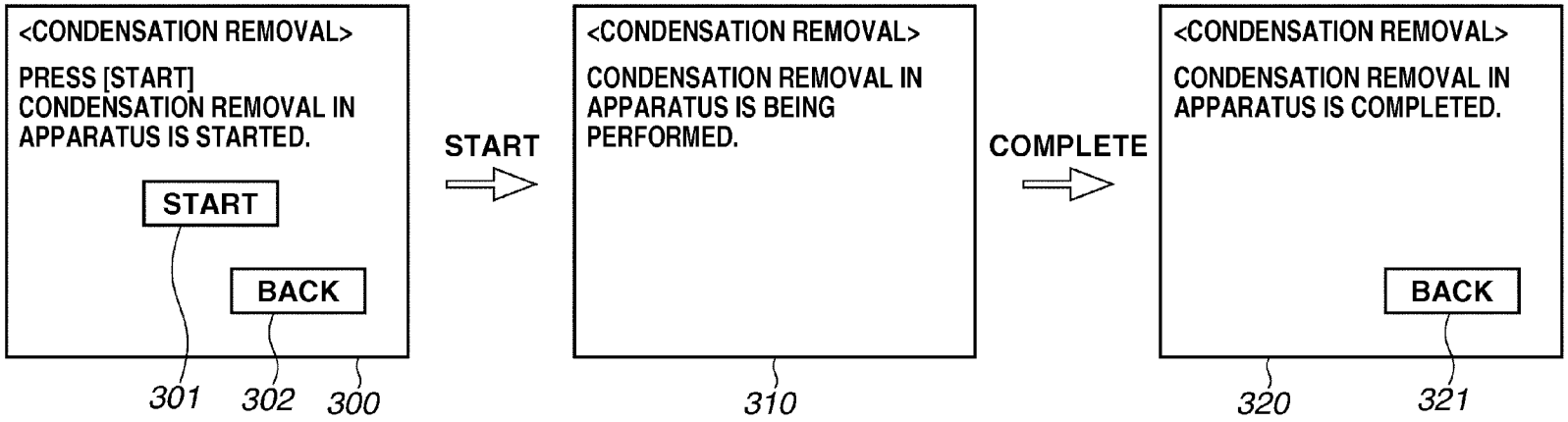
FIG. 3 is an example illustrating a condensation removal operation screen displayed on an operation unit 112.

FIG. 3 is an example illustrating a condensation removal operation screen displayed on the operation unit 112.

The operation unit 112 is provided with a button for selecting the condensation removal. In a case the control unit 109 detects that the button is pressed, the control unit 109 causes the operation unit 112 to display an operation screen 300. In this case, the control unit 109 performs the determination processing described below to determine whether the condensation removal can be performed. In a case it is determined that the condensation removal can be performed, the control unit 109 sets a start button 301 to be pressed. In a case detecting that the start button 301 is pressed, the control unit 109 transmits the condensation removal request to the image forming unit 111, and the control unit 109 further causes the operation unit 112 to display an operation screen 310.

In a case determining that the condensation removal cannot be performed, the control unit 109 displays the start button 301 in gray not to detect that the start button 301 is pressed. In a case the control unit 109 detects that a return button 302 is pressed, the control unit 109 causes the operation unit 112 to display the screen that is displayed before the operation screen 300 is displayed.

The operation screen 310 displays a phrase indicating that the condensation removal is being performed. In a case the image forming unit 111 is completed the condensation removal processing, the control unit 109 causes the operation unit 112 to display an operation screen 320. The operation screen 320 displays a phrase indicating that the condensation removal is completed. In a case the control unit 109 detects that a button 321 is pressed, the control unit 109 causes the operation unit 112 to display the screen that is displayed before the operation screen 300 is displayed.

Figure 4:
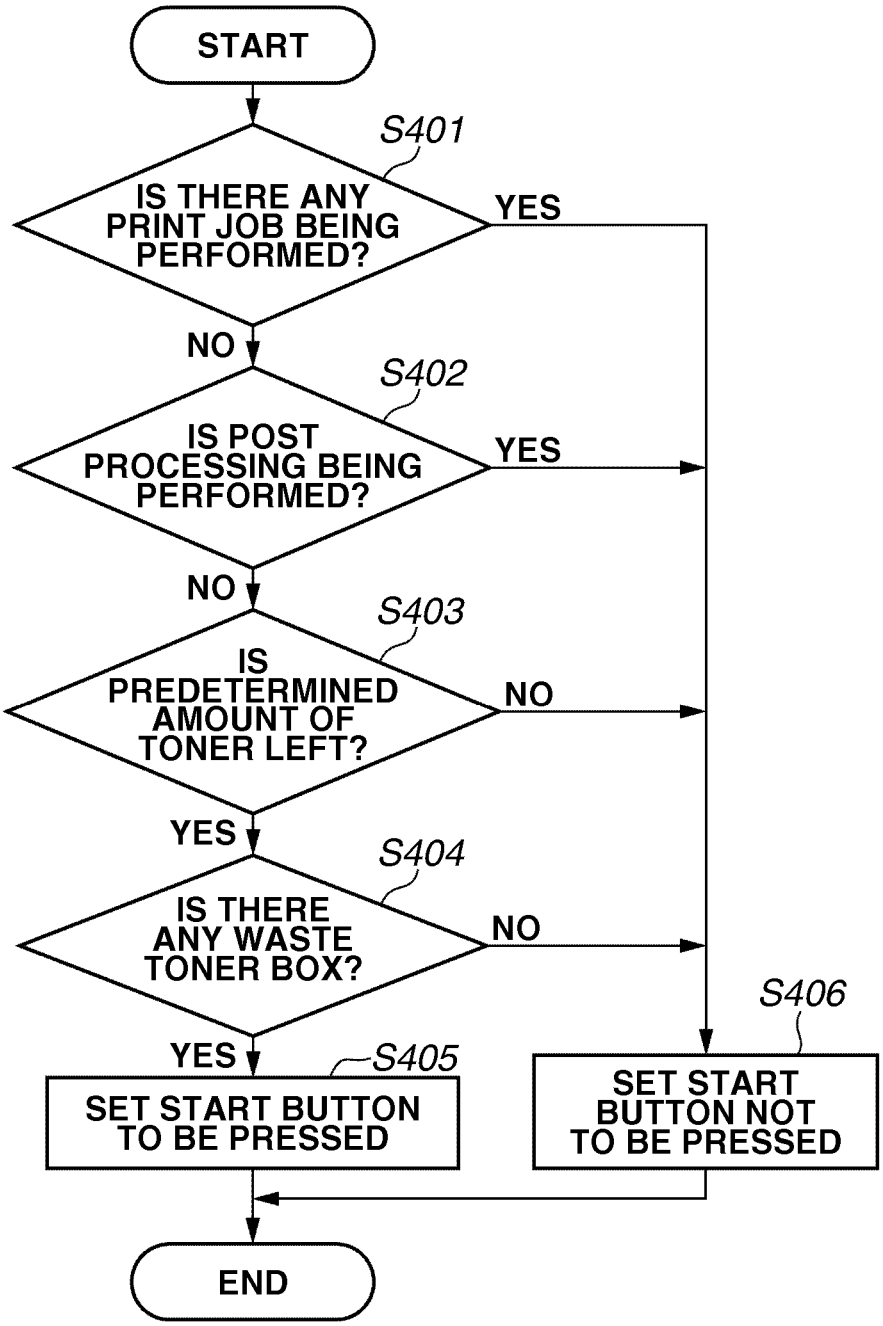
FIG. 4 is a flowchart illustrating determination processing for determining whether condensation removal can be performed.

FIG. 4 is a flowchart illustrating determination processing for determining whether the condensation removal can be performed. The CPU executes a program based on the flowchart illustrated in FIG. 4 to perform the determination processing based on the flowchart illustrated in FIG. 4.

In step S401, the control unit 109 reads the job list stored in the storage unit 108 and determines whether any print job is being performed based on the job list. The print job refers to, for example, the PDL print job based on the print data received from an external information processing apparatus or a copy job instructed from the operation unit 112. In a case a job is being performed (YES in step S401), the processing proceeds to step S406.

In a case no job is being performed (NO in step S401), in step S402, the control unit 109 monitors the status information received from the image forming unit 111 and determines based on the status information whether the image forming unit 111 is performing the post-processing. In a case the image forming unit 111 is performing the post-processing (YES in step S402), the processing proceeds to step S406.

In a case the image forming unit 111 is not performing the post-processing (NO in step S402), in step S403, the control unit 109 determines whether a predetermined amount of toner remains in the image forming unit 111. The control unit 109 can receive the status information indicating the amount of remaining toner from the image forming unit 111, and determines based on the status information whether the predetermined amount of toner remains in the image forming unit 111. In a case the predetermined amount of toner does not remain (NO in step S403), the processing proceeds to step S406.

In a case the predetermined amount of toner remains (YES in step S403), in step S404, the control unit 109 determines whether the waste toner box 209 is placed. Since the amount of waste toner that can be stored in the waste toner box 209 is limited, the user has to remove the waste toner box 209 from the image forming apparatus 102 on a periodic basis to discard the waste toner stored in the waste toner box 209.

Therefore, it is likely to happen that the waste toner box 209 is not placed. Using a sensor provided in a region where the waste toner box 209 is stored, it can be detected whether the waste toner box 209 is removed. The sensor includes, for example, a weight sensor. In a case the waste toner box 209 is not placed (NO in step S404), the processing proceeds to step S406.

In a case the waste toner box 209 is placed (YES in step S404), in step S405, the control unit 109 causes the operation unit 112 to display the operation screen 300, and the control unit 109 sets the start button 301 illustrated in FIG. 3 to be pressed. The control unit 109 starts to detect that the start button 301 is pressed. On the other hand, in step S406, although the control unit 109 causes the operation unit 112 to display the operation screen 300, the control unit 109 causes the operation unit 112 to display the start button 301 in gray. In this case, the user cannot give the instruction for starting the condensation removal. By displaying the start button in gray, the user can easily recognize that the start button cannot be pressed.

According to the description of FIG. 4, in a case a job is being performed or the post-processing is being performed, the control unit 109 does not transmit the condensation removal request to the image forming unit 111. However, the print job may be generated after the control unit 109 transmits the condensation removal request to the image forming unit 111 and before the control unit 109 receives from the image forming unit 111 the status information indicating that the condensation removal is being performed.

Figure 5:
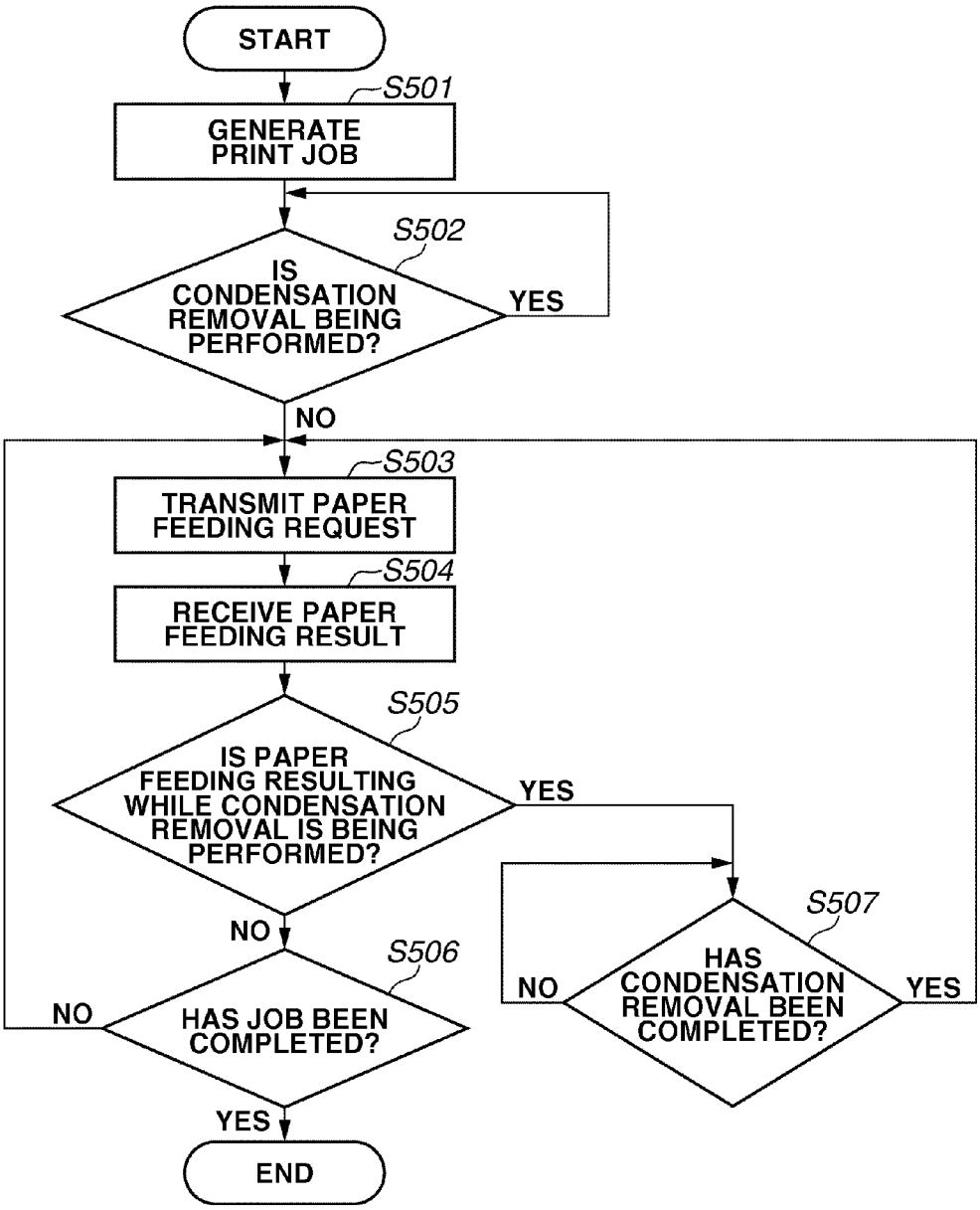
FIG. 5 is a flowchart illustrating processing performed in a case a performance of a print job and that of condensation removal compete against each other.

FIG. 5 is a flowchart illustrating processing performed in a case a performance of the print job and that of the condensation removal compete against each other. The CPU executes the program based on the flowchart illustrated in FIG. 5 to perform the processing based on the flowchart illustrated in FIG. 5.

In step S501, the control unit 109 generates the print job according to an instruction for starting printing input via the operation unit 112 and the print data received from the information processing apparatus 101. In step S502, prior to transmitting the paper feeding request for the print job to the image forming unit 111, the control unit 109 determines whether the condensation removal is being performed.

In a case receiving the status information indicating that the condensation removal is being performed as a response to the condensation removal request transmitted to the image forming unit 111 (YES in step S502), the control unit 109 determines that the condensation removal is being performed. In this case, the control unit 109 waits until receiving from the image forming unit 111 the status information indicating that the condensation removal is completed. In a case receiving no status information indicating that the condensation removal is being performed (NO in step S502), or in a case receiving the status information indicating that the condensation removal is completed, the control unit 109 determines that the condensation removal is not being performed.

In a case it is determined that the condensation removal is not being performed, in step S503, the control unit 109 transmits the paper feeding request to the image forming unit 111. In step S504, the control unit 109 receives the status information indicating the paper feeding result from the image forming unit 111. The paper feeding result indicates success or failure of feeding paper. Further, in a case the paper feeding result indicates the failure of feeding the paper, the paper feeding result includes causes thereof.

The causes of the failure include cases where the paper feeding cassette does not store the recording paper, where the recording paper being conveyed is jammed, or where the condensation removal is being performed. The failure of feeding paper includes that the paper feeding cannot be started due to some causes. In FIG. 5, the control unit 109 focuses on whether the paper feeding is failed due to the condensation removal. Other operations for other causes are not described in FIG. 5.

In step S505, based on the paper feeding result, the control unit 109 determines whether the paper feeding is failed due to the condensation removal. In a case the paper feeding is not been failed (NO in step S505), in step S506, the control unit 109 determines whether printing is completed on all pages based on the print job. In a case printing is not been completed on all pages (NO in step S506), the control unit 109 transmits the paper feeding request to the image forming unit 111 again to print the next page.

Ina case the paper feeding is failed (Yes in step S505), in step S507, the control unit 109 determines whether the condensation removal is completed. In other words, the control unit 109 waits until receiving from the image forming unit 111 the status information indicating that the condensation removal is completed. In a case the condensation removal is completed (YES in step S507), the control unit 109 transmits the paper feeding request for the print job again to the image forming unit 111.

According to the exemplary embodiments illustrated in FIGS. 3 and 4, in a case a necessary condition for performing the condensation removal is not satisfied, the control unit 109 sets the start button 301 in gray. However, the control unit 109, instead of setting the start button 301 in gray, may set the start button 301 not to transfer the condensation removal request to the image forming unit 111 even in a case the start button 301 is pressed. In this case, according to the start button 301 being pressed, the control unit 109 causes the operation unit 112 to display a phrase of "Condensation removal cannot be performed".

According to the exemplary embodiment illustrated in FIG. 4, four conditions as the necessary conditions for performing the condensation removal are illustrated. In addition, other conditions according to a method of the condensation removal may be provided. For example, the conditions may include that a predetermined time has elapsed since the previous condensation removal has been performed, or a predetermined time has elapsed since the print job has been performed. By providing the conditions as described above, more than necessary condensation removal processing can be prevented from being performed.

As described above, even if the performance of the print job and that of the condensation removal compete against each other, the print job can be performed without disturbing the condensation removal. In other words, without being disturbed by the print job, the condensation removal can be performed with an appropriate timing.

Further, the present invention can be realized by performing the processing described below. Specifically, software (program) for realizing the functions of the exemplary embodiment described above is supplied to the system or the apparatus via the network or various kinds of storage mediums, and then a computer (or the CPU or a micro processing unit (MPU)) of the system or the apparatus reads the program to perform the processing.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An image forming apparatus comprising:

a condensation removal unit configured to perform condensation removal absorbing condensation with toner in the image forming apparatus;

an accepting unit configured to accept information from a user, the information indicating a degree of an amount of toner to be used for the condensation removal; and a setting unit configured to set the amount of toner to be used for the condensation removal according to the information accepted from the user, wherein the condensation removal unit performs the condensation removal by using the amount of toner set by the setting unit.

2. The image forming apparatus according to claim 1, further comprising a display unit configured to display a screen for accepting the information from the user, wherein the setting unit sets the amount of toner, according to the information accepted from the user via the screen, as the amount of toner to be used for the condensation removal.

3. The image forming apparatus according to claim 1, further comprising a storage unit capable of being removed from the image forming apparatus configured to store the toner used to absorb the condensation.

4. The image forming apparatus according to claim 1, further comprising a printing unit configured to perform printing on recording paper using the toner.

5. The image forming apparatus according to claim 4, wherein the printing unit configured to form an image on a drum using toner and transfer the toner onto recording paper.

6. The image forming apparatus according to claim 5, wherein, in the condensation removal, the condensation removal unit causes the toner to adhere to the drum and does not transfer the toner onto recording paper.

7. A method of condensation removal performed in an image forming apparatus, the method comprising:

accepting information from a user, the information indicating a degree of an amount of toner to be used for a condensation removal absorbing condensation with toner;

setting the amount of toner to be used for the condensation removal according to the information accepted from the user; and performing the condensation removal by using the set amount of toner.

8. A non-transitory recording medium that stores a computer-readable program of an image forming apparatus that is performed by a computer, the program comprising:

code for accepting information from a user, the information indicating a degree of an amount of toner to be used for a condensation removal absorbing condensation with toner;

code for setting the amount of toner to be used for the condensation removal according to the information accepted from the user; and code for performing the condensation removal by using the set amount of toner.

* * * * *